US005186032A

United States Patent [19]

Chia

[11] Patent Number: 5,186,032

[45] Date of Patent: Feb. 16, 1993

[54] NUMERAL LOCK WITH CHANGEABLE UNLOCKING NUMBERS

[76] Inventor: Tzyh-Suenn Chia, No. 52-5, Lane 39, Ton May Road, Hsinchu, Taiwan

[21] Appl. No.: 754,950

[22] Filed: Sep. 4, 1991

[51] Int. Cl.[5] ..... E05B 37/16

[52] U.S. Cl. ..... 70/315; 70/213; 70/305; 70/289

[58] Field of Search ..... 70/213, 214, 301, 304, 70/305, 315, 289

[56] References Cited

U.S. PATENT DOCUMENTS

| | | | |
|---|---|---|---|
| 1,612,384 | 12/1926 | Loken | 70/304 |
| 2,477,182 | 7/1949 | Hosking | 70/315 |
| 3,967,477 | 7/1976 | Harrington et al. | 70/315 |
| 4,220,023 | 9/1980 | Beede | 70/315 |
| 4,941,334 | 7/1990 | Fish et al. | 70/214 |

FOREIGN PATENT DOCUMENTS

| | | | |
|---|---|---|---|
| 559825 | 5/1956 | Italy | 292/153 |

*Primary Examiner*—Renee S. Luebke
*Assistant Examiner*—D. Boucher
*Attorney, Agent, or Firm*—Morton J. Rosenberg; David I. Klein

[57] ABSTRACT

The numeral lock with changeable combinations includes a housing, handle members disposed on opposite sides of the housing, a slider member mounted in the housing, a plurality of adjustable dial members provided on the housing for changing the combination of the numeral lock, and a plurality of notches or numbers provided on the housing circumferentially spaced about the dial members. The adjustable dial members can be set to an unlocking position to open the numeral lock. A setting knob mounted on the housing can be pulled outwardly to change the positions of the adjustable dial members for changing the combination of the numeral lock.

1 Claim, 8 Drawing Sheets

NUMERAL LOCK WITH CHANGEABLE UNLOCKING NUMBERS

BACKGROUND OF THE INVENTION

One advantage of a numeral lock is that it can unlocked without a key. A numeral lock can be used by many people at the same time who need not be inconvenienced by carrying a key. Some prior art numeral locks have only one combination which cannot be changed. Thus, the numeral lock must be discarded if the combination is disclosed to an unauthorized user.

There still remains a need for a numeral lock with a plurality of sets of unlocking numbers which are changeable at will.

SUMMARY OF THE INVENTION

It is an object of the present invention to mitigate and/or obviate the above-mentioned drawbacks in the manner set forth in the detailed description of the Preferred Embodiment.

The primary object of this invention is to provide a new numeral lock whose combination is changeable at will.

Another object of the present invention is to provide a numeral lock whose combination can be changed from one side of the numeral lock.

Further objects and advantages of the present invention will become apparent as the following description proceeds, and the features of novelty which are characterized in the claims annexed to and form a part of this invention.

Figure 6:
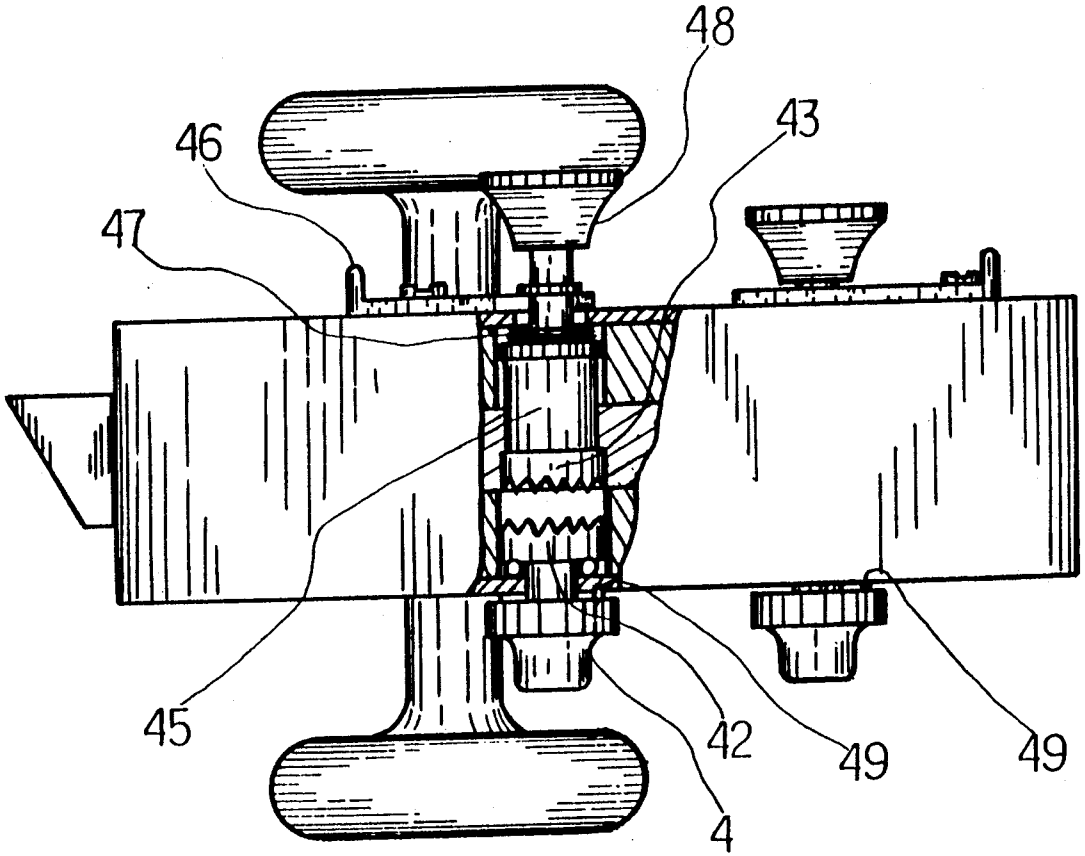
Figure 7:
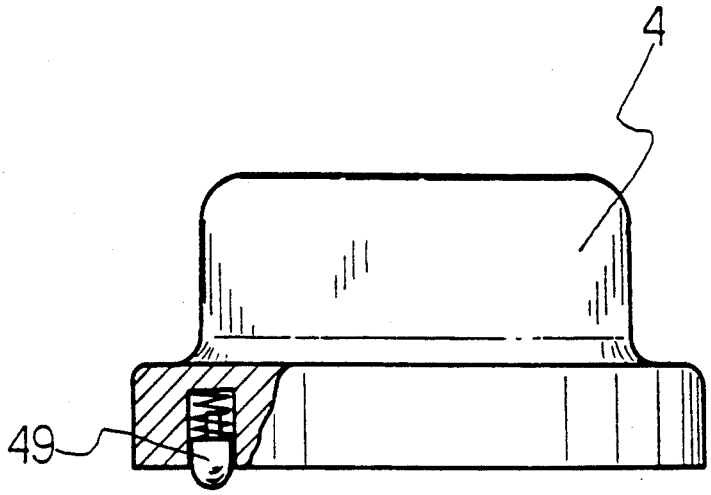
Figure 8:
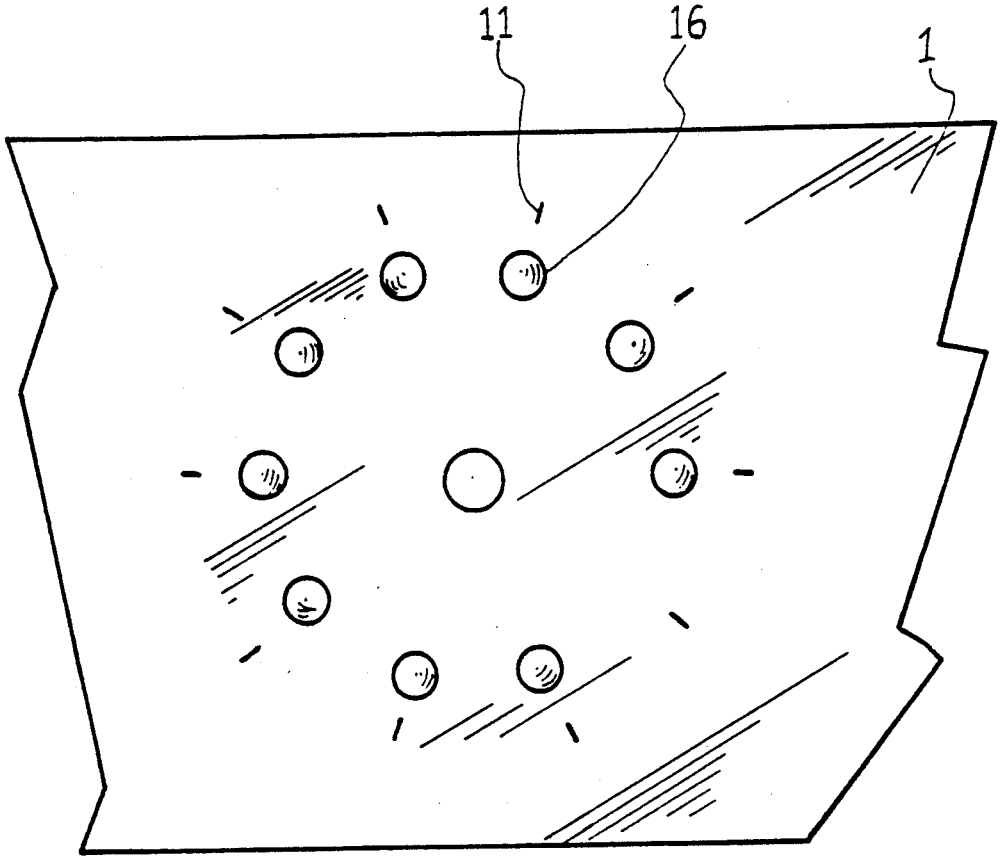

PIG. 5 is a top cross-sectional view of a preferred embodiment in an unlocked position according to the present invention;

FIG. 6 is a longitudinal cross-sectional view of a preferred embodiment showing the changing of the combination of the numeral lock of the present invention;

FIG. 7 is a partial sectional view of an adjustable dial member of the present invention; and, FIG. 8 is a view of the numeral lock without the adjustable dial members of the present invention.

DETAILED DESCRIPTION OF THE PREFERRED EMBODIMENT

Figure 1:
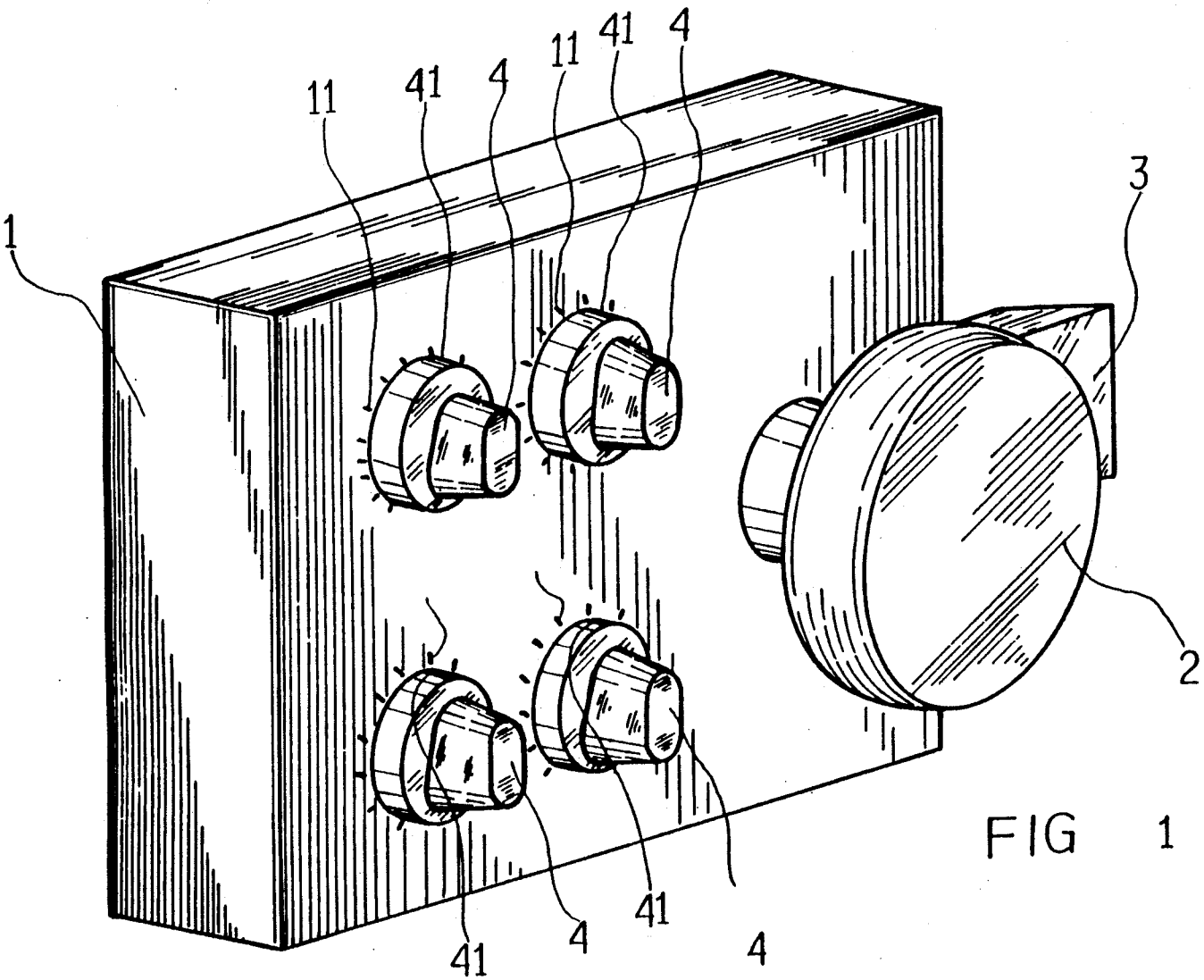
FIG. 1 is a perspective assembled embodiment of the present invention.
Figure 2:
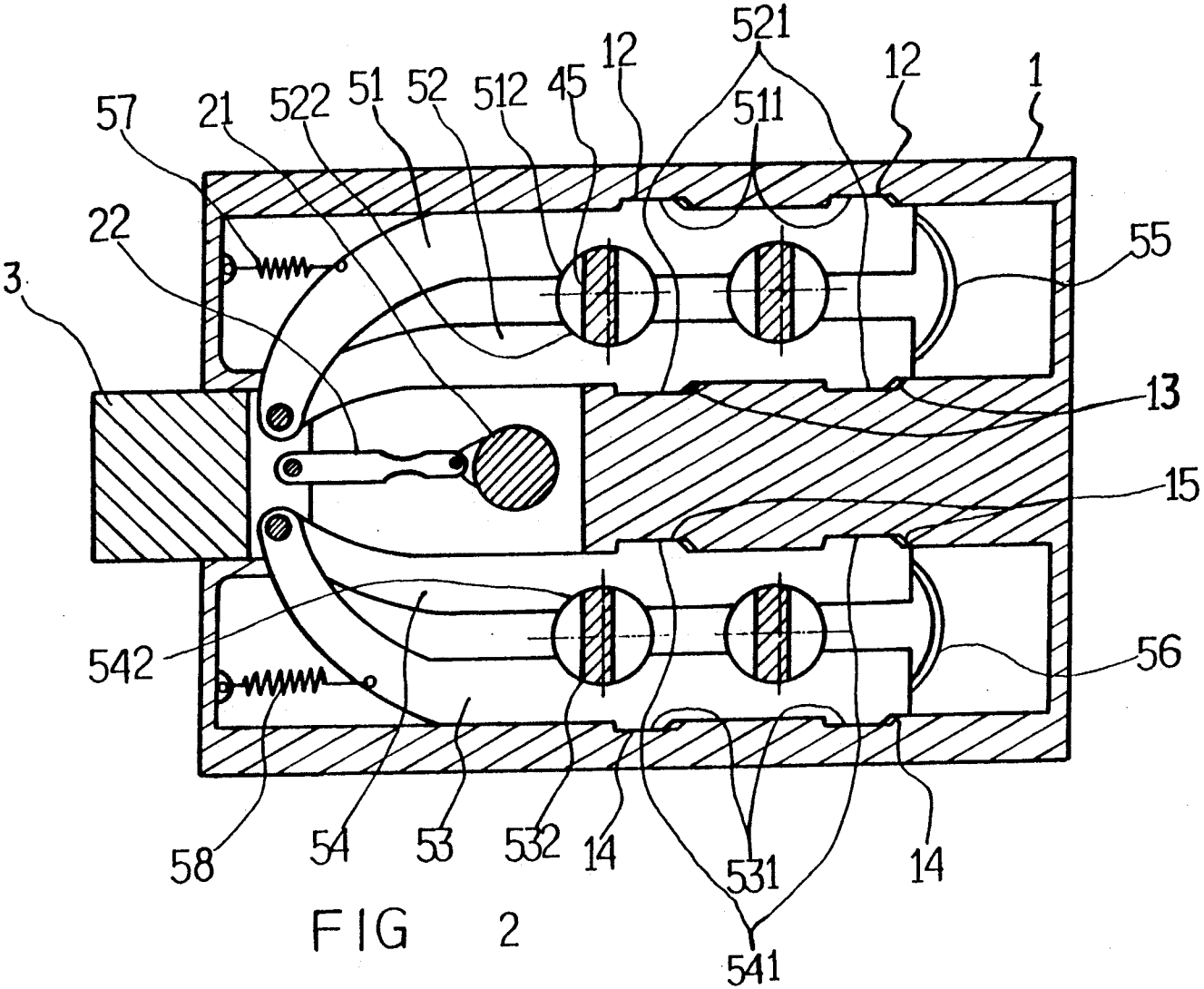
FIG. 2 is a longitudinal cross-sectional view of the preferred embodiment in a locked position according to the present invention.
Figure 3:
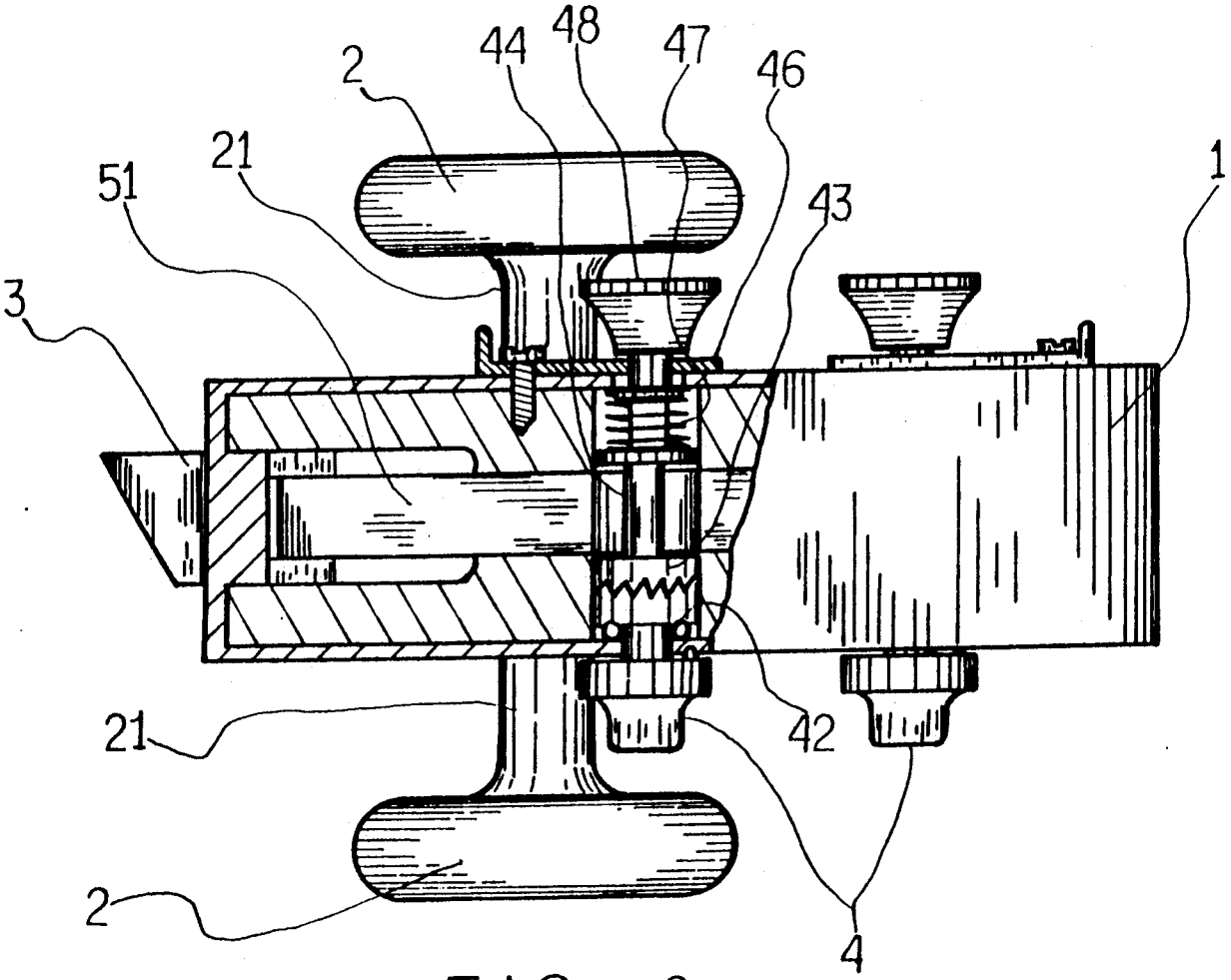
FIG. 3 is a top cross-sectional view of the preferred embodiment in a locked position according to the present invention.

Referring to FIGS. 1-3, the present invention includes a housing 1, a pair of handle members 2, a slider member 3, and a plurality of adjustable dial members 4 which are provided with related marks 41 circumferentially spaced thereon to show the designated positions of the dial members 4. Disposed about the dial members 4 on the housing 1 are several notches or numbers 11 etched on the housing 1.

The interior of the housing i is separated into two chambers, one of which is provided with two sliding link members 51 and 52, and the second with sliding link members 53 and 54. Link members 51, 52, 53 and 54 are all pivotally connected at one end to the slider member 3. Outward projections 511, 521, 531, and 541 of the sliding link members 51, 52, 53 and 54, respectively, are removably received by recesses 12, 13, 14, and 15 formed in the housing 1. A shaft 21 of the handle member passes through the housing 1 and connects with one end of a connector rod 22. The opposed end of the connector rod 22 is connected with the slider member 3. Two springs 57 and 58 are set between the front inner face of the housing 1 and sliding link members 51 and 53. The sliding links members 51 and 58 are forwardly slidable. Two arch springs 55 and 56 are provided on the ends of the pairs of link members 51, 52 and 53, 54, respectively, to connect and to provide outward forces on the link members for firmly retaining the projections 511, 521, 531 and 541 in the recesses 12, 13, 14, and 15, respectively.

A shaft of the adjustable dial members 4 extends into the housing 1 and connects with a first gear 42. A setting knob 48 disposed on the housing 1 opposite the adjustable dial members 4 is mounted on a locking rod 44 that slidably extends into the housing 1. A second gear 44 disposed on the opposed end of the locking rod 44 is adapted to mate with the first gear 42. The locking rod 44 has a rectangular stopper 45 which is disposed within a space formed by related arch grooves 512, 522 and 532, 542. The first end of the locking rod 44 is received by a coil spring 47 and connects with a fixing link 46.

Figure 4:
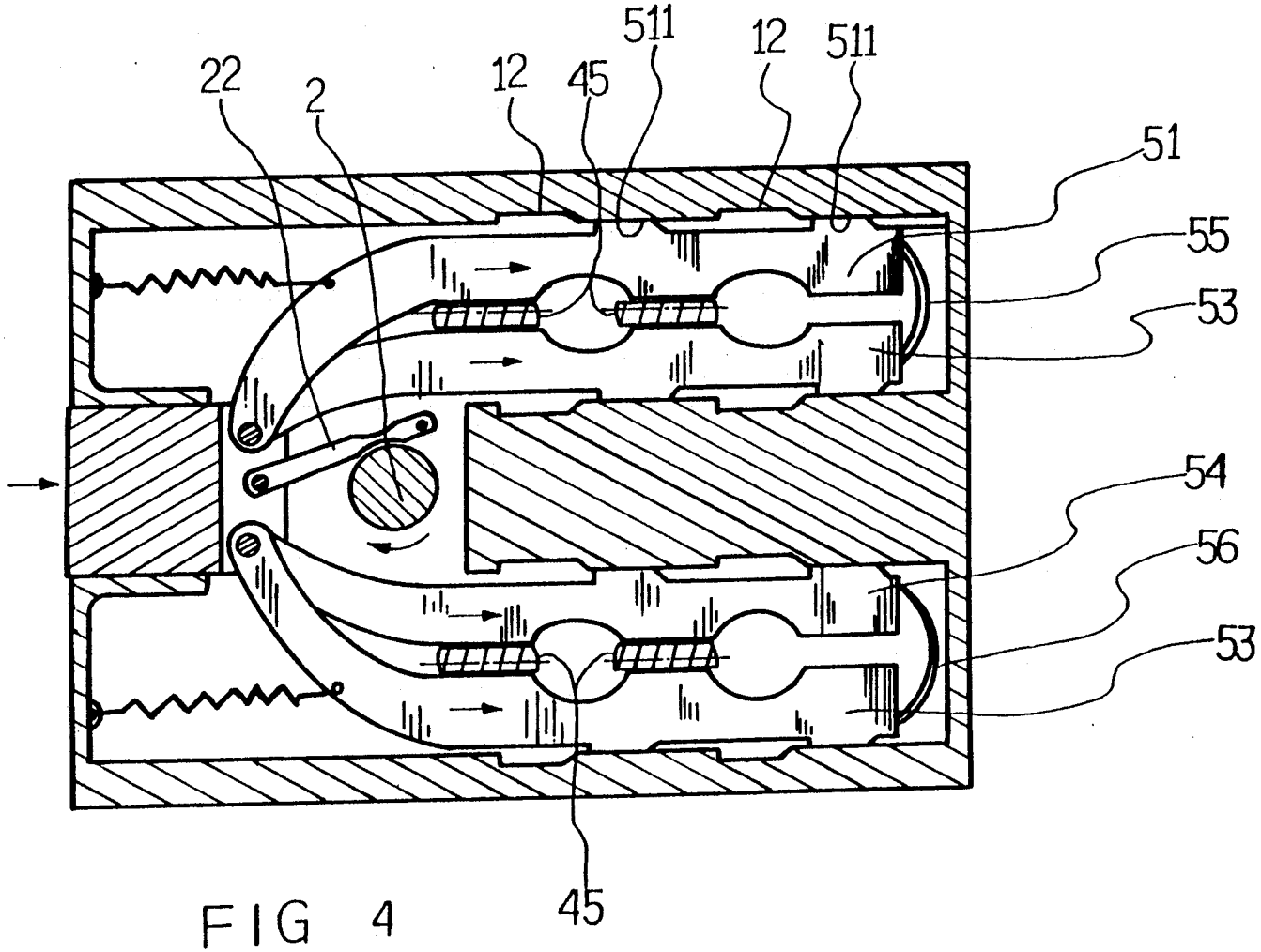
FIG. 4 is a longitudinal cross-sectional view of a preferred embodiment in an unlocked position according to the present invention.
Figure 5:
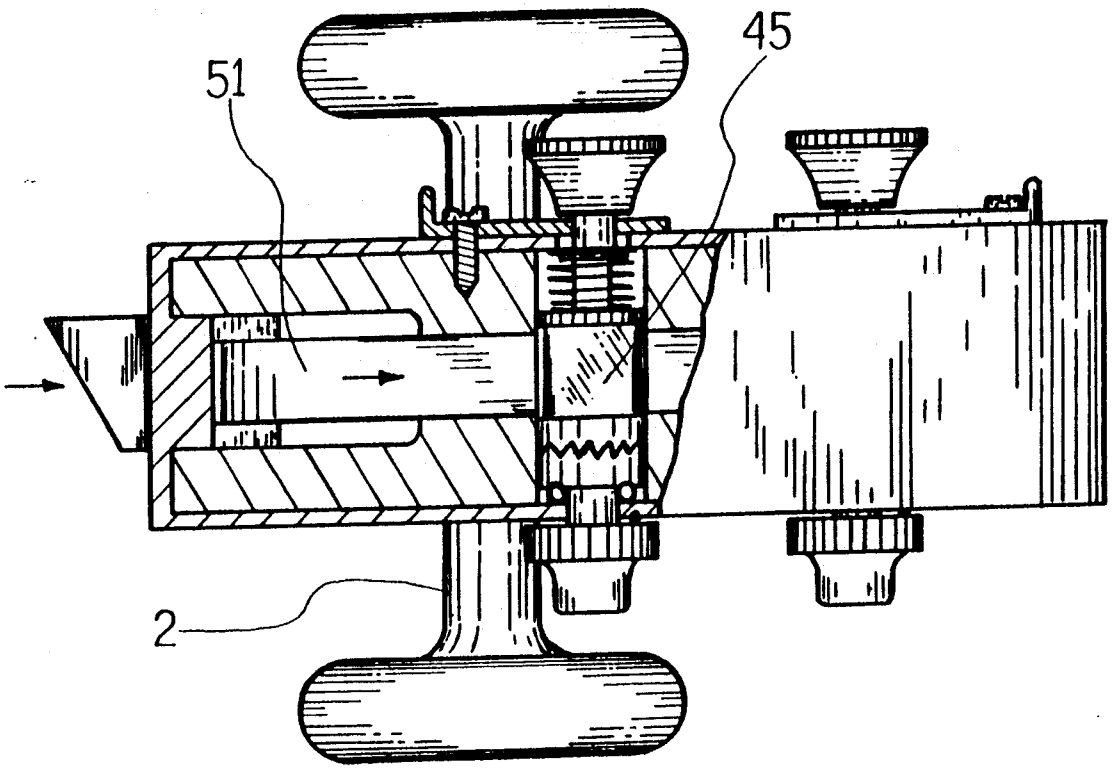

FIGS. 2 and 3 show the locking state of the numeral lock. Each projection of the sliding link members is received by a related recess formed in the housing 1, and the two ends of the stopper 45 contacts the inner edges of the link members, thereby immobilizing the link members and locking the numeral lock of the present invention. Then the stoppers 45 are rotated to be parallel to the link members as shown in FIGS. 4 and 5, the link members are pressed inwardly and the projections on the link members are pushed from the related recesses as the handle 2 is rotated to move the slider member inwardly, thereby unlocking the numeral lock.

The combination of the numeral lock is changeable. The user may rotate the adjustable dial members 4 to an unlocking position and then pull outwardly the setting knob 48 from the housing 1, as shown in FIG. 6, to separate the first gear 42 from the second ear 43. The user may rotate the adjustable dial members 410 to any desired position and release the setting knob 48 to set the new combination of the numeral lock. Referring to FIGS. 7 and 8, each adjustable dial member 4 is provided with a spring and related ball set 49. The housing 1 is provided with a plurality of circumferentially spaced recesses 16 which are adapted to receive the ball of the spring and ball set 49. When an adjustable dial member 4 is rotated, the ball will be received by a recess 16, thereby locking the adjustable dial member in place.

As various possible embodiments might be made of the above invention without departing from the scope of the invention, it is to be understood that all matter herein described as shown in the accompanying drawings is to be interpreted as illustrative and not in a limiting sense. Thus, it will be appreciated that the drawings are exemplary of a preferred embodiment of the invention.

I claim:

1. A numeral lock comprising:

a housing having two interior chambers, said housing having a plurality of recesses formed in an inner surface;

a handle member having a rotatable shaft extending through said housing and a handle disposed on opposite ends thereof;

a slider member mounted in said housing and being extendable therefrom;

a plurality of rotatable dial members mounted on said housing, each said dial member having a shaft extending into said housing and a first gear disposed on an end of said shaft of each said dial member;

a pair of link members slidably disposed in each of the respective chambers of said housing, each said pair of link members having a first end pivotally connected to said slider member and a plurality of projections formed thereon that are received by said recesses of said housing;

a connector rod having a first end connected to said shaft of said handle member and a second end attached to said slider member;

a setting knob mounted on a first end of a locking rod slidably extending into said housing, and a second gear disposed on a second end of said locking rod, said second gear being adapted to engage with said first gear, whereby a combination of said numeral lock is changeable by pulling said setting knob outwardly from said housing to separate said second gear from said first gear, rotating said dial members to any desired notch on said housing, and releasing said setting knob.

* * * * *